US005787802A

United States Patent [19]

McNab

[11] Patent Number: 5,787,802

[45] Date of Patent: Aug. 4, 1998

[54] COMPACT DISC EMBOSSING DEVICE

[76] Inventor: D. Bruce McNab, 35 Verona Ave., Newark, N.J. 07104

[21] Appl. No.: 695,110

[22] Filed: Aug. 8, 1996

[51] Int. Cl.[6] ..... B44B 5/00

[52] U.S. Cl. ..... 101/4; 101/31.1

[58] Field of Search ..... 101/4, 31.1

[56] References Cited

U.S. PATENT DOCUMENTS

| | | | |
|---|---|---|---|
| 1,679,029 | 7/1928 | Gibson | 101/31.1 |
| 2,706,448 | 4/1955 | Priesmeyer | 101/31.1 |
| 2,937,590 | 5/1960 | Priesmeyer | 101/31.1 |
| 4,278,017 | 7/1981 | Conjura | 101/31.1 |
| 5,375,515 | 12/1994 | Morgan | 101/4 |

*Primary Examiner*—Edgar S. Burr
*Assistant Examiner*—Leslie Grohusky

[57] ABSTRACT

A compact disc embossing device including a base member. A handle is pivotally disposed with the base member. The handle has a hooked portion formed on an interior surface thereof. An embossing disc is coupled with the handle. A corresponding raised boss is secured to a lower portion of the base member. A locking pin selectively engages the hooked portion of the handle.

1 Claim, 3 Drawing Sheets

COMPACT DISC EMBOSSING DEVICE

BACKGROUND OF THE INVENTION

1. Field of the Invention

The present invention relates to a compact disc embossing device and more particularly pertains to embossing a compact disc for identification of ownership purposes with a compact disc embossing device.

2. Description of the Prior Art

The use of compact disc markers is known in the prior art. More specifically, compact disc markers heretofore devised and utilized for the purpose of applying identifying markings are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,435,246 to Edman discloses an identification stamp for compact discs.

U.S. Pat. No. 5,375,515 to Morgan discloses a compact disc marking apparatus.

U.S. Pat. No. 5,320,19 to Ward discloses a compact disc identification kit.

U.S. Pat. No. 5,313,881 to Morgan discloses a compact disc marking apparatus.

U.S. Pat. No. 4,574,693 to Fink et al. discloses a seal press.

U.S. Pat. No. 4,204,468 to Harrison discloses an embossing press.

While these devices fulfill their respective, particular objective and requirements, the aforementioned patents do not describe a compact disc embossing device for embossing a compact disc for identification of ownership purposes.

In this respect, the compact disc embossing device according to the present invention substantially departs from the conventional concepts and designs of the prior art, and in doing so provides an apparatus primarily developed for the purpose of embossing a compact disc for identification of ownership purposes.

Therefore, it can be appreciated that there exists a continuing need for new and improved compact disc embossing device which can be used for embossing a compact disc for identification of ownership purposes. In this regard, the present invention substantially fulfills this need.

SUMMARY OF THE INVENTION

In the view of the foregoing disadvantages inherent in the known types of compact disc markers now present in the prior art, the present invention provides an improved compact disc embossing device. As such, the general purpose of the present invention, which will be described subsequently in greater detail, is to provide a new and improved compact disc embossing device and method which has all the advantages of the prior art and none of the disadvantages.

To attain this, the present invention essentially comprises a compact disc of a circular configuration. The compact disc has a central aperture therethrough. A circular label is disposed around the central aperture. The device includes a base member being in a generally horizontally disposed U-shaped configuration. The base member has an upper portion and a lower portion joined together by inwardly extending end portions thereof. The upper portion is defined by a pair of opposed planar members having an intermediate space therebetween. The planar members each have corresponding horizontal slots therethrough. The lower portion has a generally rectangular lower surface. The lower surface has legs extending downwardly from four corners thereof. Each of the legs has a rubber foot secured thereto. The device includes a handle having a generally J-shaped configuration. The handle is comprised of an elongated upper end and a short lower end. The short lower end is positioned within the intermediate space and pivotally disposed between the pair of opposed planar members of the upper portion of the base member. The handle has a hooked portion formed on an interior surface thereof disposed between the elongated upper end and the short lower end. The device includes an embossing disc having a planar and circular configuration. The embossing disc has a pin extending upwardly from an upper surface thereof. The pin couples with the short end of the handle whereby the embossing disc is positioned below the pair of opposed planar members of the upper portion of the base member. A corresponding raised boss is secured to an upper surface of the lower portion of the base member. A spring pin extends between the corresponding horizontal slots of the planar members of the upper portion of the base member. The spring pin selectively engages the hooked portion of the handle.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved compact disc embossing device which has all the advantages of the prior art compact disc markers and none of the disadvantages.

It is another object of the present invention to provide a new and improved compact disc embossing device which may be easily and efficiently manufactured and marketed.

It is a further object of the present invention to provide a new and improved compact disc embossing device which is of durable and reliable construction.

An even further object of the present invention is to provide a new and improved compact disc embossing device which is susceptible of a low cost of manufacture with regard to both materials and labor, and which accordingly is then susceptible of low prices of sale to the consuming public, thereby making such a compact disc embossing device economically available to the buying public.

Still yet another object of the present invention is to provide a new and improved compact disc embossing device which provides in the apparatuses and methods of the prior art some of the advantages thereof, while simultaneously overcoming some of the disadvantages normally associated therewith.

Even still another object of the present invention is to provide a new and improved compact disc embossing device for embossing a compact disc for identification of ownership purposes.

Lastly, it is an object of the present invention to provide a new and improved compact disc embossing device including a base member. A handle is pivotally disposed with the base member. The handle has a hooked portion formed on an interior surface thereof. An embossing disc is coupled with the handle. A corresponding raised boss is secured to a lower portion of the base member. A locking pin selectively engages the hooked portion of the handle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
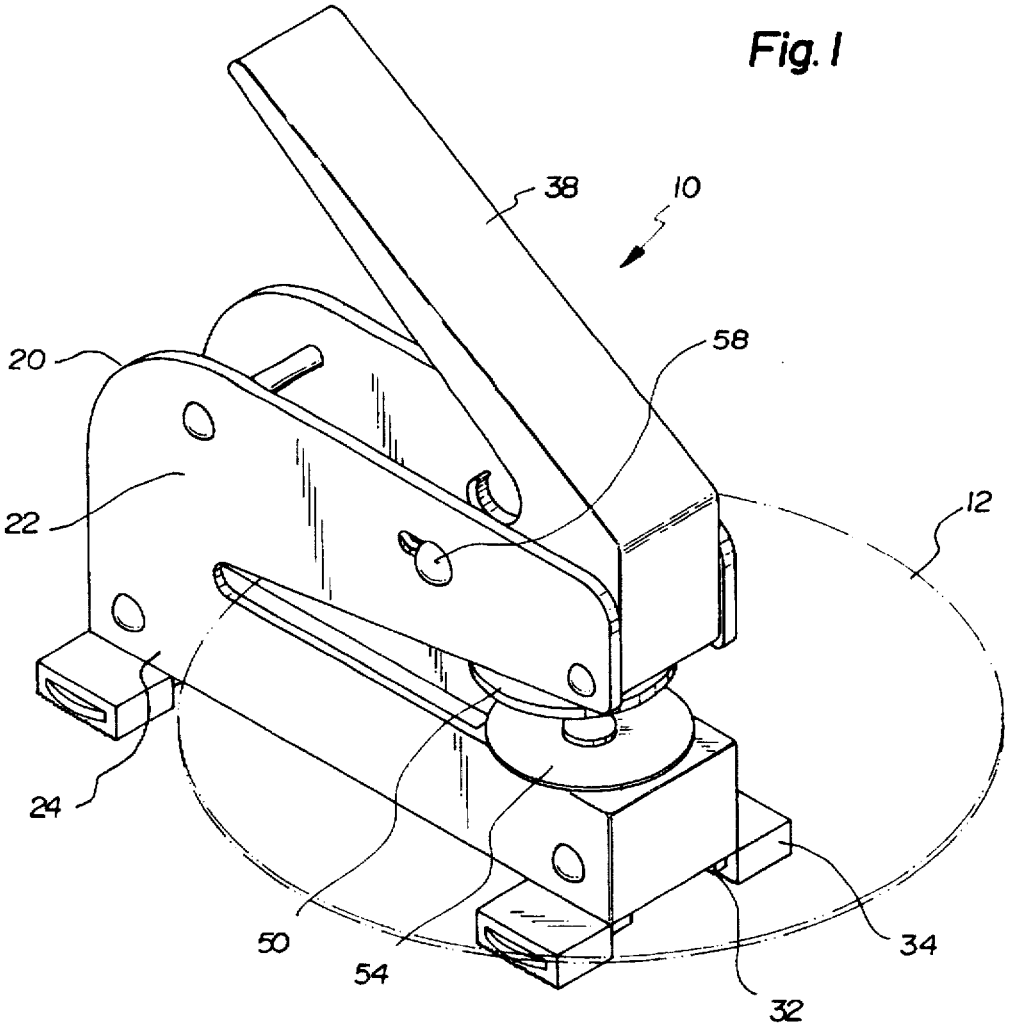
FIG. 1 is a perspective view of the preferred embodiment of the compact disc embossing device constructed in accordance with the principles of the present invention.
Figure 2:
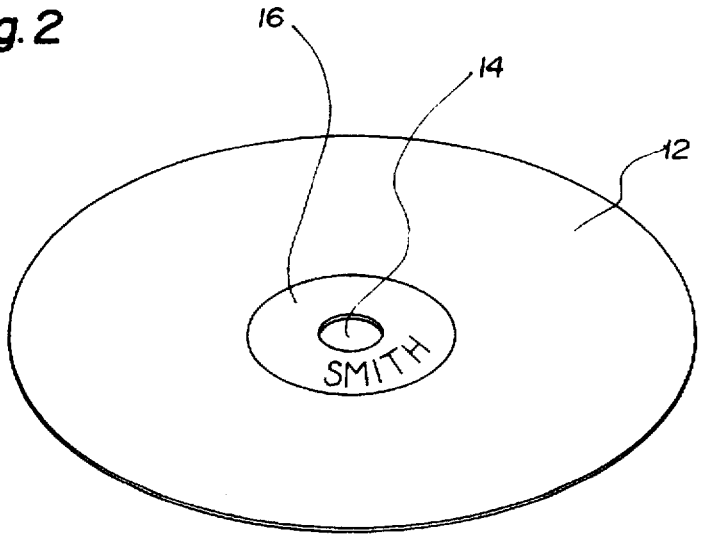
FIG. 2 is a perspective view of an embossed compact disc of the present invention.
Figure 3:
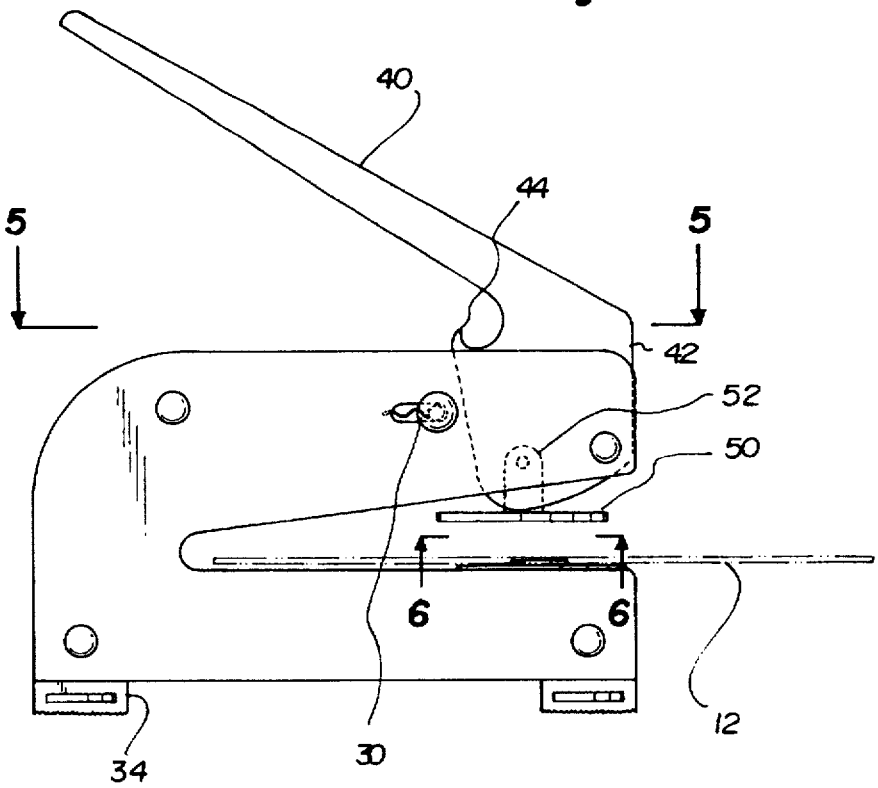
FIG. 3 is a side elevation view of the present invention.
Figure 4:
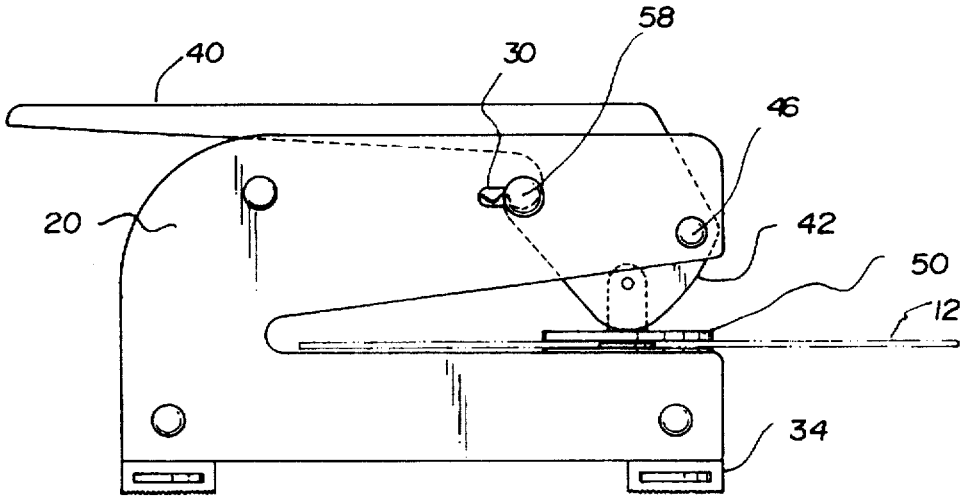
FIG. 4 is a side elevation view of the present invention in an engaged orientation.
Figure 5:
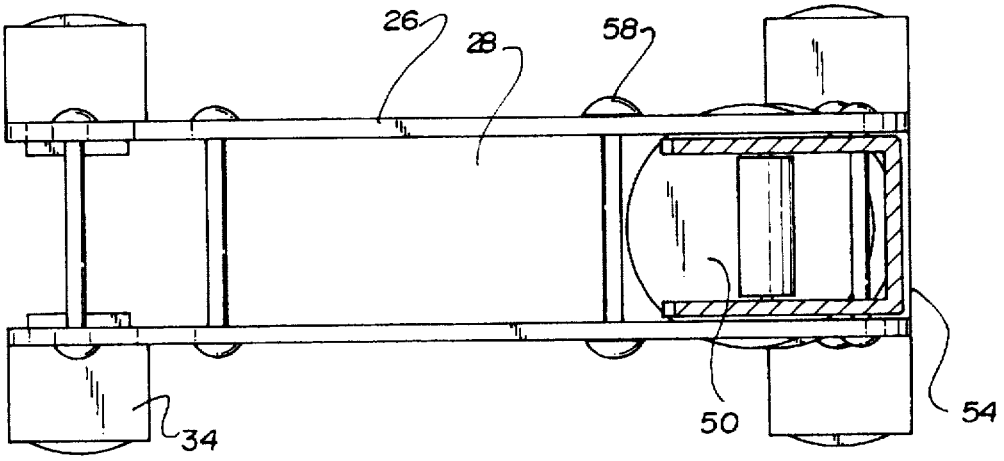
FIG. 5 is a cross-sectional view as taken along line 5—5 of FIG. 3.
Figure 6:
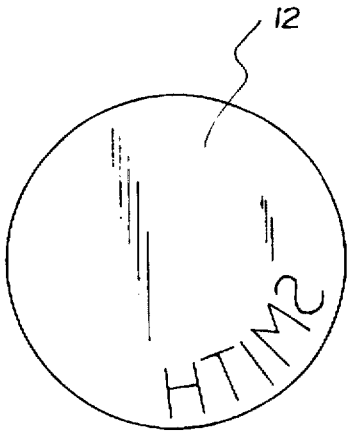
FIG. 6 is a cross-sectional view as taken along line 6—6 of FIG. 3.

With reference now to the drawings, and in particular, to FIGS. 1–6 thereof, the preferred embodiment of the new and improved compact disc embossing device embodying the principles and concepts of the present invention and generally designated by the reference number 10 will be described.

Specifically, it will be noted in the various Figures that the device relates to a compact disc embossing device for embossing a compact disc for identification of ownership purposes. In its broadest context, the device consists of a compact disc, a base member, a handle, an embossing disc and a spring pin. Such components are individually configured and correlated with respect to each other so as to attain the desired objective.

The device 10 includes a compact disc 12 of a circular configuration. The compact disc 12 has a central aperture 14 therethrough. A circular label 16 is disposed around the central aperture 14. The circular label 16 is the portion of the compact disc 12 that will be embossed by the device 10.

The device 10 includes a base member 20 being in a generally horizontally disposed U-shaped configuration. The base member 20 has an upper portion 22 and a lower portion 24 joined together by inwardly extending end portions thereof. The general shape of the base member 20 resemble a standard stapler. The upper portion 22 is defined by a pair of opposed planar members 26 having an intermediate space 28 therebetween. The planar members 26 each have corresponding horizontal slots 30 therethrough. The lower portion 24 has a generally rectangular lower surface. The lower surface has legs 32 extending downwardly from four corners thereof. Each of the legs 32 has a rubber foot 34 secured thereto. The rubber feet 34 will prevent the device 10 from sliding when in place atop a recipient surface, such as a tabletop.

Next, the device 10 includes a handle 38 having a generally J-shaped configuration. The handle 38 is comprised of an elongated upper end 40 and a short lower end 42. The short lower end 42 is positioned within the intermediate space 28 and pivotally disposed between the pair of opposed planar members 26 of the upper portion 22 of the base member 20. The handle 38 has a hooked portion 44 formed on an interior surface thereof disposed between the elongated upper end 40 and the short lower end 42. A pivot pin 46 couples the handle 38 with the pair of opposed planar members 26 thereby allowing the handle 38 to be raised or lowered to accomplish a desired task of the device 10.

The device 10 also includes an embossing disc 50 having a planar and circular configuration. The embossing disc 50 has a pin 52 extending upwardly from an upper surface thereof. The pin 52 couples with the short end 42 of the handle 38 whereby the embossing disc 50 is positioned below the pair of opposed planar members 26 of the upper portion 22 of the base member 20. A corresponding raised boss 54 is secured to an upper surface of the lower portion 24 of the base member 20. The embossing disc 50 is equipped with a stamped identification that can be embossed onto the compact disc 12 for identification purposes. The embossing disc 50 will be personalized for each particular user.

Lastly, a spring pin 58, i.e. a pin having a spring, extends between the corresponding horizontal slots 30 of the planar members 26 of the upper portion 22 of the base member 20. The spring pin 58 selectively engages the hooked portion 44 of the handle 38. In use, the user will position the compact disc 12 on the raised boss 54. The handle 38 is pressed downwardly whereby the spring pin 58 can be pushed along the horizontal slots 30 to engage the hooked portion 44 of the handle 38. Once a selected length of time passes, the spring pin 58 is pushed away thereby releasing the hooked portion 44 and allowing the handle 38 to be raised. The newly embossed disc (FIGS. 2 and 6) is then removed and is now properly identified.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the united states is as follows:

1. A compact disc embossing device for embossing a compact disc for identification of ownership purposes comprising, in combination:

a compact disc of a circular configuration, the compact disc having a central aperture therethrough, a circular label disposed around the central aperture;

a base member being in a generally horizontally disposed U-shaped configuration, the base member having an upper portion and a lower portion joined together by inwardly extending end portions thereof, the upper portion being defined by a pair of opposed planar members having an intermediate space therebetween, the planar members each having corresponding horizontal slots therethrough, the lower portion having a generally rectangular lower surface, the lower surface having legs extending downwardly from four corners thereof, each of the legs having a rubber foot secured thereto;

a handle having a generally J-shaped configuration, the handle comprised of an elongated upper end and a short lower end, the short lower end being positioned within the intermediate space and pivotally disposed between the pair of opposed planar members of the upper portion of the base member, the handle having a hooked portion formed on an interior surface thereof disposed between the elongated upper end and the short lower end, wherein a pivot pin couples the handle with the pair of opposed planar members thereby allowing the handle to be raised and lowered;

an embossing disc having a planar and circular configuration, the embossing disc having a pin extending upwardly from an upper surface thereof, the pin coupling with the short end of the handle whereby the embossing disc being positioned below the pair of opposed planar members of the upper portion of the base member, a corresponding raised boss secured to an upper surface of the lower portion of the base member, the raised boss having an identification stamped thereon;

a pin having a spring, the pin extending between the corresponding horizontal slots of the planar members of the upper portion of the base member, the pin selectively engaging the hooked portion of the handle.

* * * * *